US005094345A

United States Patent [19]

Yonnetti

[11] Patent Number: 5,094,345

[45] Date of Patent: Mar. 10, 1992

[54] GOLF CLUB ORGANIZING DEVICE

[76] Inventor: Edward Yonnetti, 9695B Boca Gardens Pky., Boca Raton, Fla. 33496

[21] Appl. No.: 630,012

[22] Filed: Dec. 19, 1990

[51] Int. Cl.[5] ..... A63B 55/00; A63B 55/04

[52] U.S. Cl. ..... 206/315.2; 266/315.3; 266/315.6

[58] Field of Search ..... 206/315.3, 315.5, 315.6; 224/918; 248/96

[56] References Cited

U.S. PATENT DOCUMENTS

| | | | |
|---|---|---|---|
| 2,324,439 | 7/1943 | Thommen | 248/96 |
| 3,532,313 | 10/1970 | Brayton | 248/96 |
| 4,319,616 | 3/1982 | Light | 206/315.6 X |
| 4,383,563 | 5/1983 | Kirchhoff | 206/315.3 X |
| 4,664,382 | 5/1987 | Palmer et al. | 206/315.6 X |
| 4,666,038 | 5/1987 | Minneman | 224/918 X |
| 4,767,001 | 8/1988 | Kim | 248/96 X |
| 4,860,889 | 8/1989 | Lemieux et al. | 206/315.6 |
| 4,995,510 | 2/1991 | Fletcher, Jr. | 206/315.3 X |

*Primary Examiner*—Paul T. Sewell
*Assistant Examiner*—BethAnne Cicconi
*Attorney, Agent, or Firm*—H. Jay Spiegel

[57] ABSTRACT

The present invention relates to an improved golf club organizing device. The golf club organizing device is designed to be attached to a golf bag and includes openings therein for receiving woods and irons. In addition, the golf club organizing device includes features which permit the storage of golf balls, golf tees, score cards and pencils. The openings designed to receive the golf clubs also provide protection against the golf club heads being damaged by contact with other clubs.

5 Claims, 4 Drawing Sheets

GOLF CLUB ORGANIZING DEVICE

BACKGROUND OF THE INVENTION

The present invention relates to an improved golf club organizing device. In the prior art, golf club organizers are known. U.S. Pat. Nos. 4,181,167 to Ret and 4,750,617 to Anderson et al. disclose a golf club organizing device that is designed to be inserted into a golf bag. Each of these devices include golf club retention means therein to facilitate the organization of golf clubs in a bag. However, Applicant is unaware of any prior art that teaches or fairly suggests a golf club organizing device which includes means to organize, separate and protect golf club irons and woods when being carried in a golf bag.

SUMMARY OF THE INVENTION

The present invention relates to an improved golf club organizing device. The present invention includes the following interrelated aspects and features:

A) In a first aspect, the golf club organizing device is designed to be attached to a golf bag.

B) The golf club organizing device includes means to receive and hold both woods and irons. The irons are held in a recessed manner to protect the irons from damage by contacting other golf clubs. The woods holding means includes a resilient member which is designed to protect the woods from damage.

C) The golf club organizing device also includes storage means for golf balls, tees, a pencil and a score card.

Accordingly, it is a first object of the present invention to provide an improved golf club organizing device.

It is a further object of the present invention to provide means to hold golf club irons and woods in a protective manner so as to prevent damage thereto.

It is a still further object of the present invention to provide an organizing device which includes means to organize all items needed during the playing of the game of golf.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
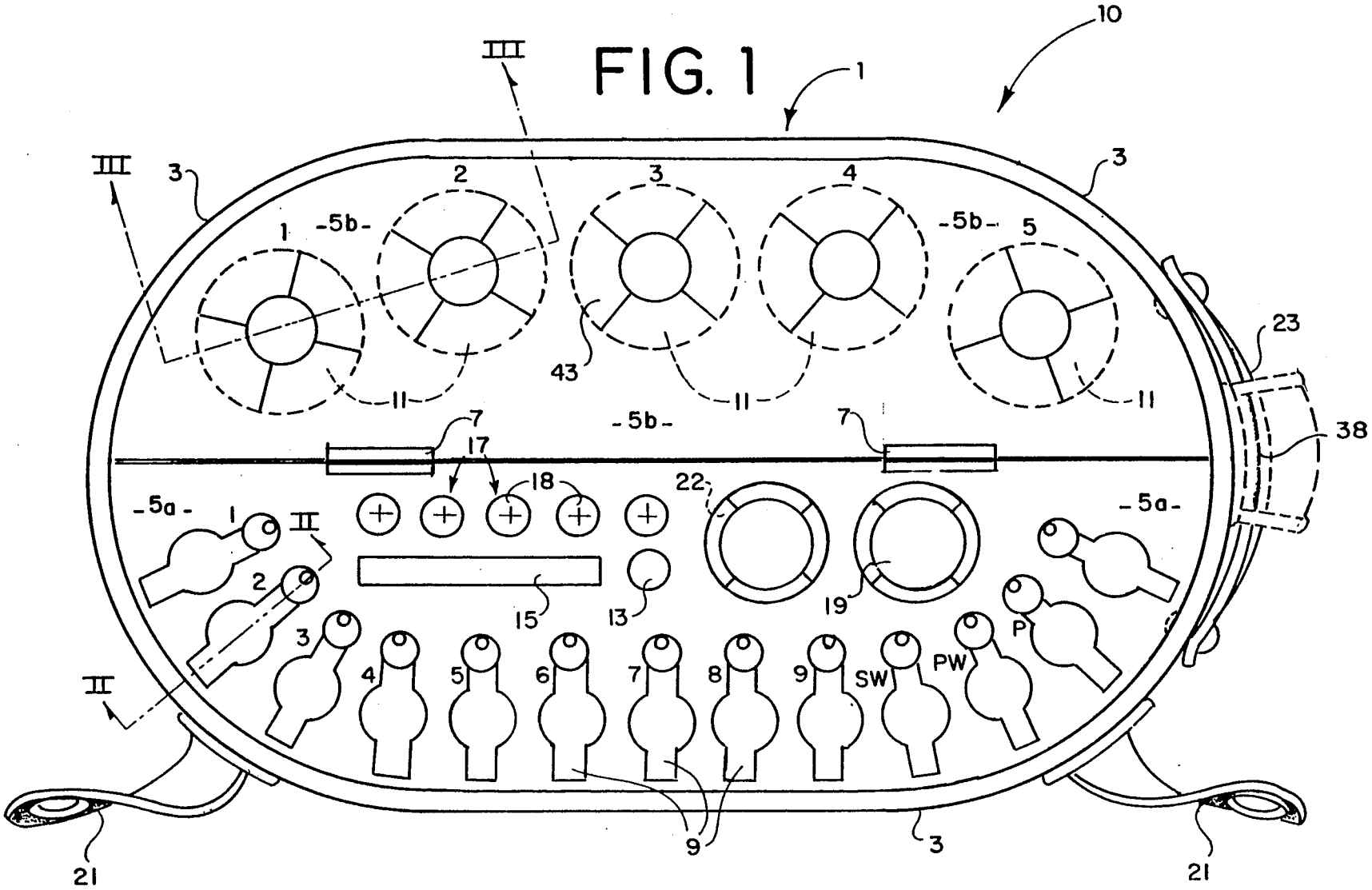
FIG. 1 shows a top view and a side view of the present invention.

With reference to FIG. 1 firstly, the golf club organizing device is generally designated by the reference numeral 10 and is seen to include an elliptically-shaped housing 1 having a rubber gasket 3 surrounding the upper edge of the housing 1. The housing 1 includes faces 5*a* and 5*b*. The face 5*b* is removably connected to the hinge means 7 such that the golf club organizing device may be used with face 5*a* only. Although not depicted, the opposite side of the housing 1, as shown in the side view of FIG. 1, includes a split aligned with the split 2 depicted therein. The hinges 7 permit the face 5*b* to be snapped in place on the organizer if desired.

The golf club organizing device also includes a plurality of iron retaining means 9, each iron retaining means including indicia associated therewith to signify which iron is to be placed in a particular retaining means.

The golf club organizing device also includes a plurality of wood retaining means 11 which are designed to receive and hold the woods of a set of golf clubs.

Also included as part of the inventive device is a cylindrical recess 13 which is designed to receive a pencil for keeping score, a rectangular recess 15 which is designed to receive a score card, a plurality of recesses 17 which are designed to receive and retain golfing tees and a golf ball retaining means 19 which is designed to hold golf balls for play. The recesses 17 are covered by slotted rubber discs which facilitate retention of tees. The golf ball retaining means include spherical recesses which are covered by rubber annular discs 22 which retain the golf balls in their respective recesses. The rubber discs may be attached to the face 5*a* in any conventional manner.

The golf club organizing device is designed to attach to the top of a golf bag. For this purpose, a plurality of snap means 21 are provided which are designed to attach to the golf bag cover snaps which exist on a golf bag. In addition, an adjustable catch 23 is included with the golf club organizing device to latch onto a golf bag carrying strap. The catch 23 includes hook and pile fastening means 38 to provide adjustability. The catch may be located in any position along the periphery of the housing 1 so as to coincide with a strap on a golf bag.

Figure 2A:
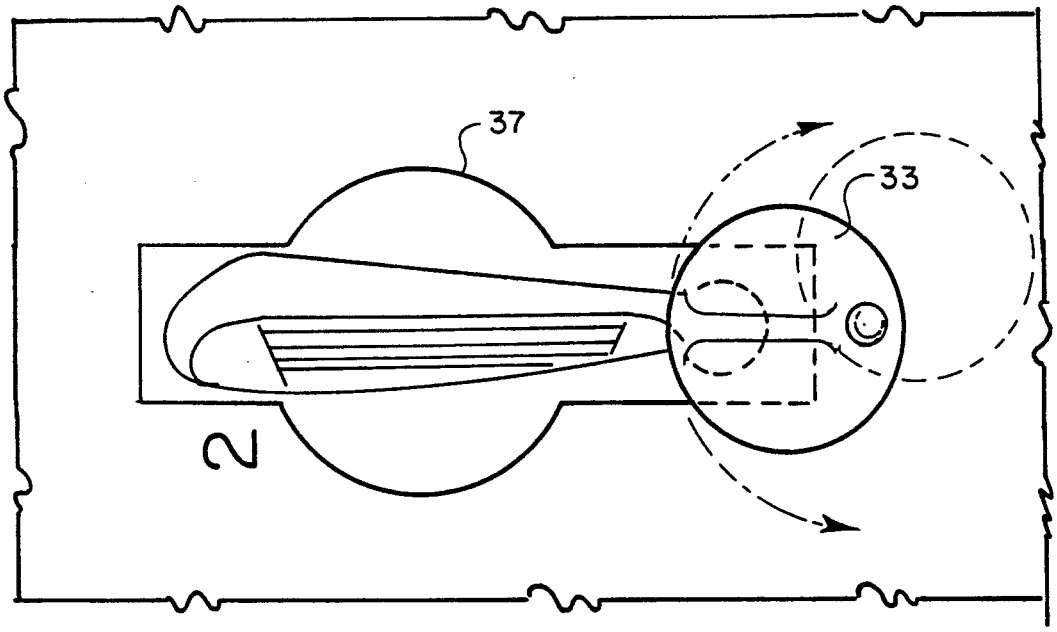
FIGS. 2*a* and 2*b* show a top view and a sectional view respectively of the means for holding irons.
Figure 2B:
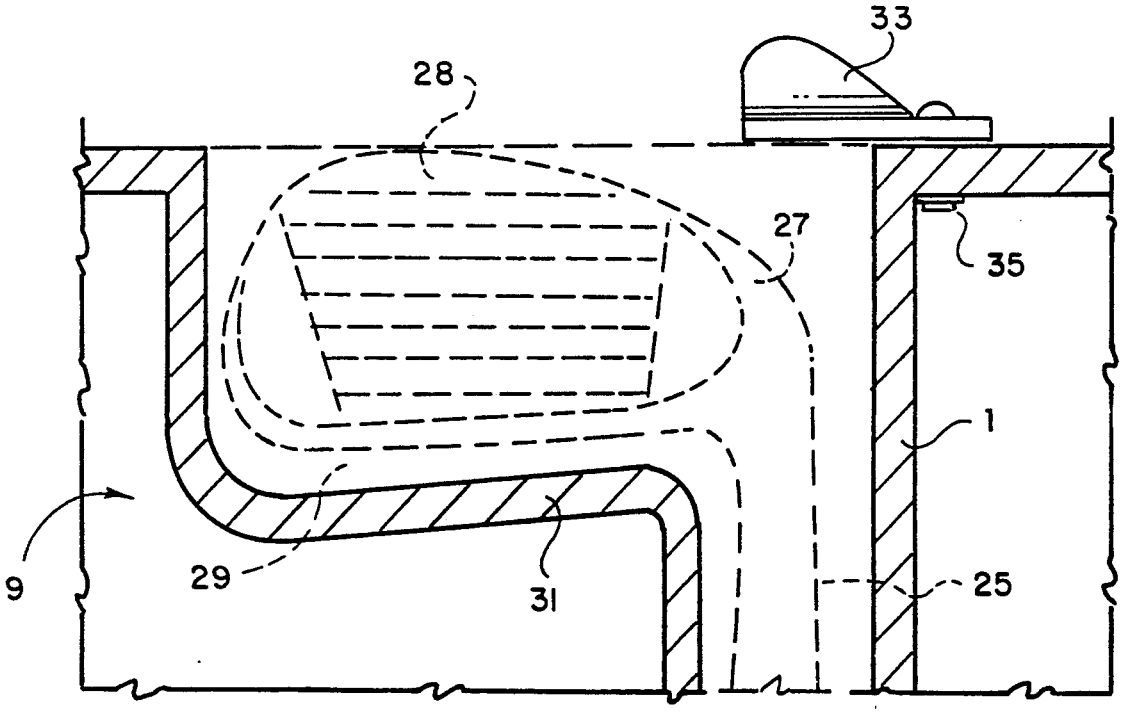

FIG. 2*b* shows a cross-sectional view and FIG. 2*a* shows a top view of one of the iron retaining means 9. Each iron retaining means 9 includes an opening 25 through the housing 1 which is adapted to receive the shaft of the iron 27. The iron retaining means 9 also includes a recess 29 which is adapted to receive the iron head 28 of the iron 27. In addition, the iron retaining means includes a horizontal support 31 which is designed to engage the iron head 28. As can be seen from the drawing, the iron retaining means is designed to hold a golf club iron such that the iron is completely recessed within the iron retaining means so as to protect the iron from contacting other irons and becoming nicked or damaged.

Each of the iron retaining means 9 also include a swivel catch 33 which is designed to secure an iron within the iron retaining means 9. The swivel catch 33 is attached to the housing 1 by pin 35 and rotates in the direction depicted in the top view shown in FIG. 2.

The iron retaining means 9 also includes a pair of cut-outs 37 in the housing 1 which permits finger access to the iron and facilitates removing the iron from the iron retaining means 9.

Figure 3B:
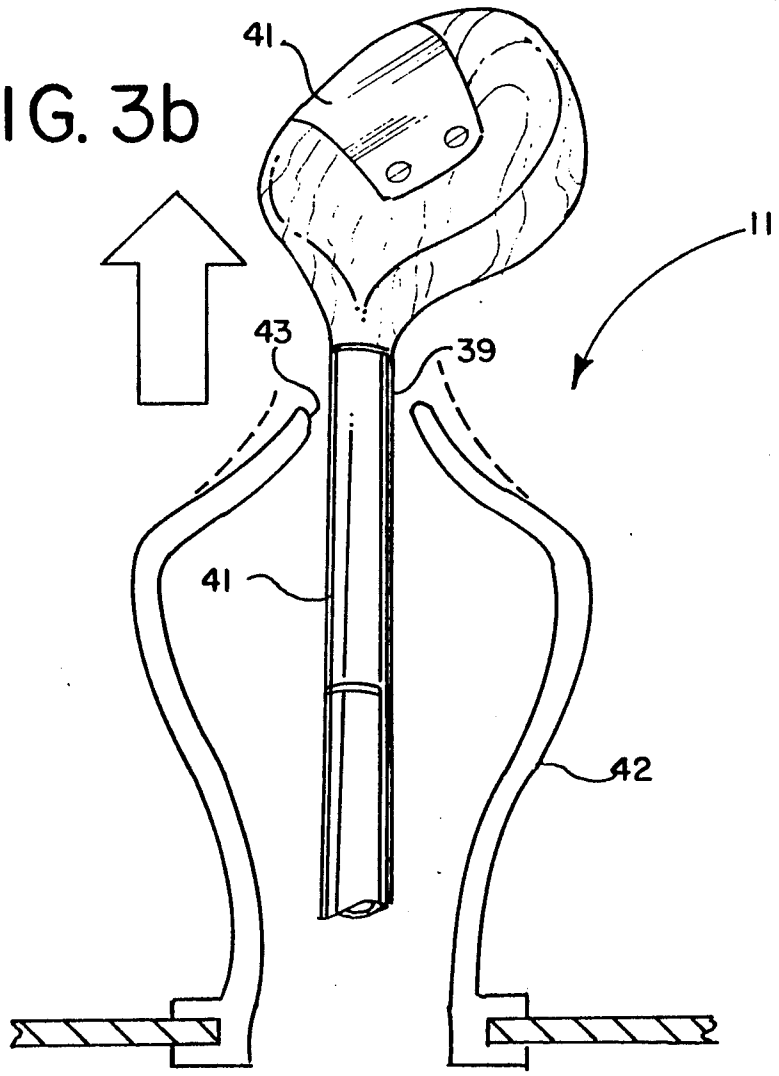
FIGS. 3*a* and 3*b* show a cross-sectional view of the means for holding woods.
Figure 3A:
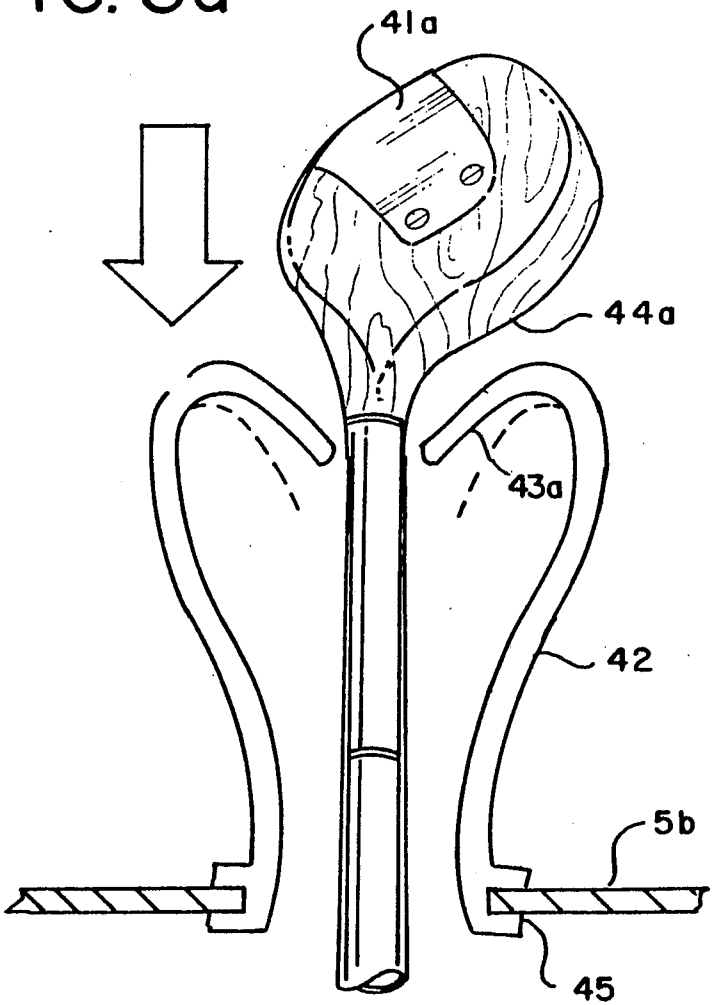

FIGS. 3*a* and 3*b* show cross-sectional views of the wood retaining means of the present invention in two orientations thereof. As can be seen from FIGS. 3*a* and 3*b*, the wood retaining means 11 includes an opening 39 which permits the woods 41 and 41*a* to be held and protected therein. The resilient member 42 is shaped like a funnel boot that conforms to the neck of each wood supporting and preventing the club from twisting. The resilient member 42 is secured to the housing 5*b* at reference numeral 45. To store, the wood 41*a* is inserted down the opening of the resilient member 42 such that the neck 44*a* contacts the lip 43*a* of the resilient member 42. To use, the wood 41 is easily lifted out by grabbing the head of wood and removing.

In a first use (FIG. 3*b*), the resilient flaps 43 of the resilient member 42 may be pulled upwardly so as to cover the wood 41 when located in the wood retaining means 11. Alternatively, as best seen in FIG. 3*a*, the flaps 43*a* can be left in a downward position with respect to the golf club 41*a*.

Figure 4:
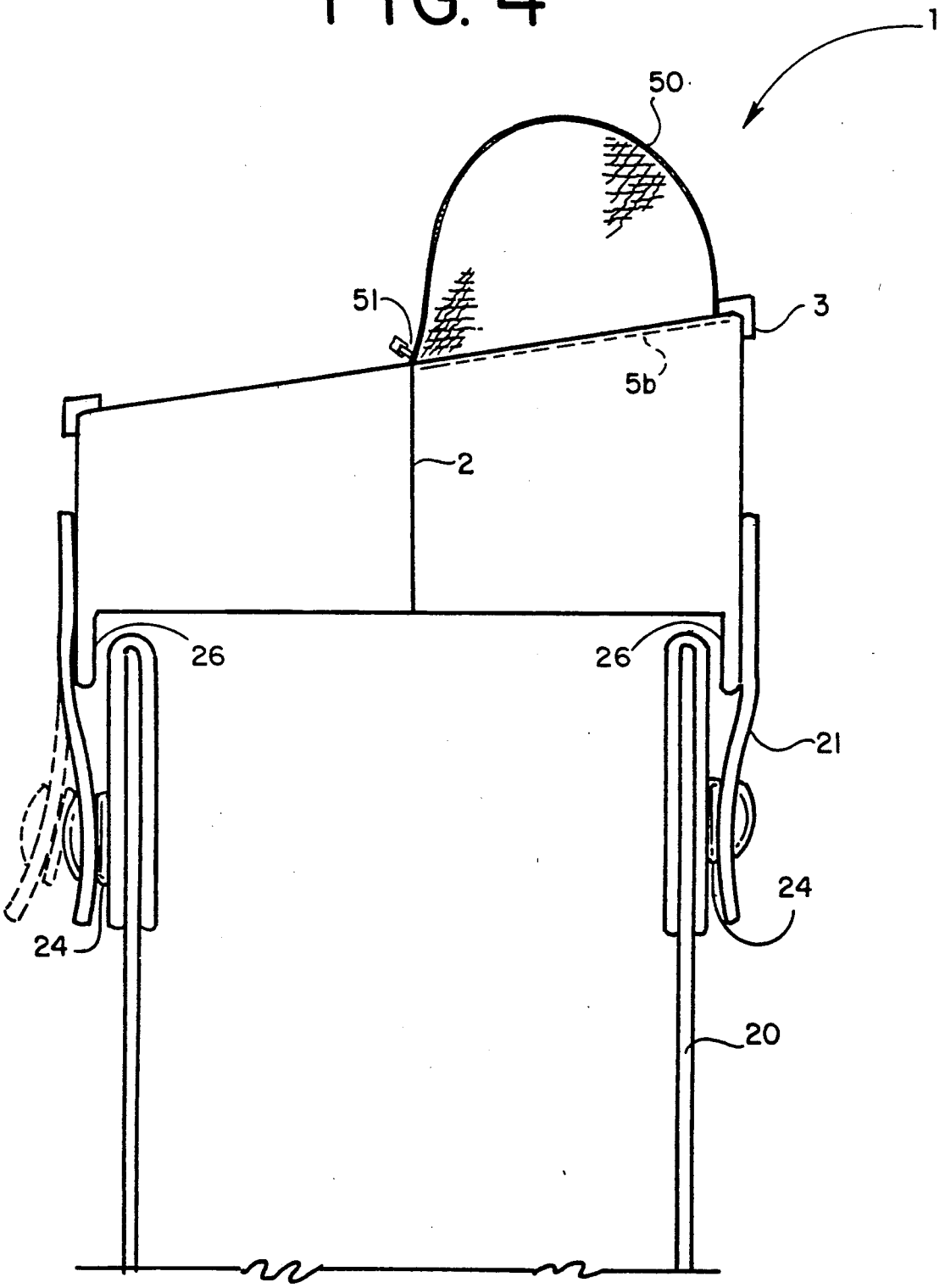
FIG. 4 shows a side view of the golf club organizing device attached to a golf bag.

With reference to FIG. 4, the housing 1 is seen attached to the top of a golf bag 20. The snap means 21 are attached to the golf club cover snaps 24 located on the golf bag. To further secure the housing 1 to the golf bag 20, the housing includes a lip 26 which is designed to surround the peripheral edge of the top of the golf bag. As an additional feature and depicted in FIG. 4 is for added protection, a zippered top cover 50 to enclose all the woods. The top cover can be made of a washable fabric. The cover is connected to the face 5*b* by a zipper connection 51 and may be unzipped and folded back to expose the woods during play.

The golf club organizer may be made out of any materials, with a preferred material being plastic. The snap-on catches for attaching to a golf bag may be made out of a fabric material and can also include an adjustable feature therewith. In addition, although the golf club organizing device is depicted in an elliptical shape, the organizing device may also be circular in shape to accommodate golf bags having a circular cross-section or other shape.

The golf club organizing device of the present invention provides advantages over other prior art devices in that it provides a golf bag organizing device that organizes, separates and protects golf club irons and woods as well as providing easy access and display of an immediate supply of golf tees, golf balls, score cards and pencils.

As such, an invention has been disclosed in terms of a preferred embodiment thereof which fulfills each and every one of the objects of the present invention as set forth hereinabove and provides a new and improved golf club organizing device of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A golf club organizing device comprising a housing having means thereon for attaching said housing to a golf bag, said housing further comprising:

a) a plurality of first retaining means for storing irons;

b) a plurality of second retaining means for storing woods each comprising a resilient member attached to said housing and including a funnel-shaped boot having a flexible lip portion sized and configured to engage the neck portion of a wood when a shaft of a wood is placed in said boot;

c) a means to store golf tees;

d) a means to store golf balls;

e) a means to store a score card; and f) a means to store a writing implement.

2. The invention of claim 1, wherein each first retaining means further comprises a chamber in said housing, each said chamber being configured such that a said iron head is substantially within a said chamber such that said iron head is protected from being damaged by contact with other golf clubs.

3. The invention of claim 2, wherein each said first retaining means further includes means to retain a said iron head in a said chamber.

4. The invention of claim 2, wherein each said chamber includes an access opening therein to facilitate removal of a said iron from a said chamber.

5. The invention of claim 1, wherein said means for attaching said housing to said golf bag further comprises:

a) a plurality of snaps, each said snap being sized to attach to golf bag cover snaps located on a said golf bag; and b) a strap, said strap being adapted to attach to a golf club carrying strap.

* * * * *